US011932954B2

(12) United States Patent
Schmid et al.

(10) Patent No.: US 11,932,954 B2
(45) Date of Patent: Mar. 19, 2024

(54) TWO-MEMBRANE CONSTRUCTION FOR ELECTROCHEMICALLY REDUCING CO2

(71) Applicant: Siemens Energy Global GmbH & Co. KG, Munich (DE)

(72) Inventors: Bernhard Schmid, Düren (DE); Christian Reller, Minden (DE); Günter Schmid, Hemhofen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 251 days.

(21) Appl. No.: 16/615,627

(22) PCT Filed: May 2, 2018

(86) PCT No.: PCT/EP2018/061102
§ 371 (c)(1),
(2) Date: Nov. 21, 2019

(87) PCT Pub. No.: WO2018/215174
PCT Pub. Date: Nov. 29, 2018

(65) Prior Publication Data

US 2020/0080211 A1 Mar. 12, 2020

(30) Foreign Application Priority Data

May 22, 2017 (DE) ..... 10 2017 208 610.6

(51) Int. Cl.
*C25B 1/00* (2021.01)
*C25B 1/23* (2021.01)
(Continued)

(52) U.S. Cl.
CPC ..... *C25B 9/23* (2021.01); *C25B 1/00* (2013.01); *C25B 1/23* (2021.01); *C25B 3/25* (2021.01);
(Continued)

(58) Field of Classification Search
CPC ..... C25B 3/26; C25B 9/21
See application file for complete search history.

(56) References Cited

U.S. PATENT DOCUMENTS 4,357,217 A 11/1982 Kuehn et al. ..... 204/84
5,437,771 A 8/1995 Shimamune et al. ..... 204/84
(Continued)

FOREIGN PATENT DOCUMENTS

AU 2018/274491 A1 10/2019 ..... C25B 1/00
CN 1275535 A 12/2000 ..... C02F 1/461
(Continued)

OTHER PUBLICATIONS

Machine translation of Lei et al CN 106552497 A (Year: 2017).*
(Continued)

*Primary Examiner* — Harry D Wilkins, III
(74) *Attorney, Agent, or Firm* — Slayden Grubert Beard PLLC

(57) ABSTRACT

Various embodiments include an electrolysis cell comprising: a cathode space housing a cathode; a first ion exchange membrane including an anion exchanger and adjoining the cathode space; an anode space housing an anode; a second ion exchange membrane including a cation exchanger and adjoining the anode space; and a salt bridge space disposed between the first ion exchange membrane and the second ion exchange membrane. The cathode comprises: a gas diffusion electrode having a porous bound catalyst structure of a particulate catalyst on a support; a coating of a particulate catalyst on the first and/or second ion exchange membrane; and a porous conductive support impregnated with a catalyst.

7 Claims, 8 Drawing Sheets

(51) Int. Cl.

| | |
|---|---|
| ***C25B 3/25*** | (2021.01) |
| ***C25B 3/26*** | (2021.01) |
| ***C25B 9/21*** | (2021.01) |
| ***C25B 9/23*** | (2021.01) |
| ***C25B 15/08*** | (2006.01) |

(52) U.S. Cl.
CPC ..... *C25B 3/26* (2021.01); *C25B 9/21* (2021.01); *C25B 15/08* (2013.01); *C25B 15/087* (2021.01)

(56) References Cited

U.S. PATENT DOCUMENTS

| | | | | |
|---|---|---|---|---|
| 9,481,939 | B2 | 11/2016 | Masel et al. | |
| 10,253,420 | B2 | 4/2019 | Zhai et al. | |
| 2004/0124079 | A1* | 7/2004 | Gestermann | C25B 11/031 427/372.2 |
| 2012/0241378 | A1* | 9/2012 | Riviello | G01N 30/96 204/252 |
| 2015/0041323 | A1* | 2/2015 | Faita | C25B 1/22 204/632 |
| 2016/0194208 | A1 | 7/2016 | Lake et al. | 423/428 |
| 2016/0251755 | A1 | 9/2016 | Kitamura et al. | 427/249.1 |
| 2017/0037522 | A1 | 2/2017 | Kaczur et al. | 204/265 |
| 2017/0073825 | A1* | 3/2017 | Sugano | C25B 11/031 |
| 2017/0259206 | A1* | 9/2017 | Masel | B01J 23/40 |
| 2017/0321334 | A1* | 11/2017 | Kuhl | C25B 1/23 |
| 2018/0195184 | A1 | 7/2018 | Fleischer et al. | |
| 2018/0230612 | A1 | 8/2018 | Krause et al. | |
| 2019/0161869 | A1* | 5/2019 | Bisselink | C25B 9/23 |
| 2021/0040627 | A1* | 2/2021 | Schmid | C25B 1/04 |
| 2021/0079538 | A1* | 3/2021 | Schmid | C25B 9/19 |
| 2021/0180196 | A1* | 6/2021 | Schmid | C25B 3/26 |

FOREIGN PATENT DOCUMENTS

| | | | | |
|---|---|---|---|---|
| CN | 102181876 | A | 9/2011 | C25B 1/00 |
| CN | 102912374 | A | 2/2013 | C25B 13/02 |
| CN | 103119017 | A | 5/2013 | C07C 51/15 |
| CN | 104593810 | A | 5/2015 | C25B 3/00 |
| CN | 103119017 | A | 1/2017 | |
| CN | 106552497 | A * | 4/2017 | C25B 1/04 |
| DE | 10 2015 215 309 | A1 | 2/2017 | C25B 11/04 |
| EP | 3 260 578 | A1 | 12/2017 | C25B 1/30 |
| FR | 2988405 | A1 * | 9/2013 | C25B 11/035 |
| GB | 2396625 | A * | 6/2004 | C02F 1/46104 |
| WO | 2017/005594 | A1 | 1/2017 | C01D 7/07 |
| WO | 2017/014635 | A1 | 1/2017 | C25B 3/04 |
| WO | WO 2017/005594 | A1 | 1/2017 | |
| WO | 2017/222382 | A1 | 12/2017 | C25B 1/30 |
| WO | 2018/215174 | A1 | 11/2018 | C25B 1/00 |
| WO | WO 2018/215174 | A1 | 11/2018 | |

OTHER PUBLICATIONS

Hori, Y., "Electrochemical CO2 Reduction on Metal Electrodes," Edited by: C. Vayenas, et al. (eds.), Modern Aspects of Electrochemistry, Springer, New York, vol. 42, pp. 89-189, 2008.

German Office Action, Application No. 10 2017 208 610.6, 10 pages, dated Jan. 30, 2018.

International Search Report and Written Opinion, Application No. PCT/EP2018/061102, 25 pages, dated Jun. 21, 2018.

Chinese Office Action, Application No. 201880033654.0, 9 pages, dated Jun. 2, 2021.

* cited by examiner

TWO-MEMBRANE CONSTRUCTION FOR ELECTROCHEMICALLY REDUCING CO2

CROSS-REFERENCE TO RELATED APPLICATIONS

This application is a U.S. National Stage Application of International Application No. PCT/EP2018/061102 filed May 2, 2018, which designates the United States of America, and claims priority to DE Application No. 10 2017 208 610.6 filed May 22, 2017, the contents of which are hereby incorporated by reference in their entirety.

TECHNICAL FIELD

The present disclosure relates to electrolysis. Various embodiments may include electrolysis cells, electrolysis systems, and/or methods of electrolysis of $CO_2$.

BACKGROUND

The combustion of fossil fuels currently covers about 80% of global energy demand. These combustion processes emitted about 34 032.7 million metric tons of carbon dioxide ($CO_2$) globally into the atmosphere in 2011. This release is the simplest way of disposing of large volumes of $CO_2$ as well (brown coal power plants exceeding 50 000 t per day). Discussion about the adverse effects of the greenhouse gas $CO_2$ on the climate has led to consideration of reutilization of $CO_2$. In thermodynamic terms, $CO_2$ is at a very low level and can therefore be reduced again to usable products only with difficulty.

In nature, $CO_2$ is converted to carbohydrates by photosynthesis. This process, which is divided up into many component steps over time and spatially at the molecular level, is copiable on the industrial scale only with great difficulty. The more efficient route at present compared to pure photocatalysis is the electrochemical reduction of the $CO_2$. A mixed form is light-assisted electrolysis or electrically assisted photocatalysis. The two terms can be used synonymously, according to the viewpoint of the observer. As in the case of photosynthesis, in this process, $CO_2$ is converted to a higher-energy product such as CO, $CH_4$, $C_2H_4$, etc. with supply of electrical energy (optionally in a photo-assisted manner) which is obtained from renewable energy sources such as wind or sun. The amount of energy required in this reduction corresponds ideally to the combustion energy of the fuel and should only come from renewable sources. However, overproduction of renewable energies is not continuously available, but at present only at periods of strong insolation and strong wind. However, this will be further enhanced in the near future with the further rollout of sources of renewable energy.

Systematic studies of the electrochemical reduction of carbon dioxide are still a relatively new field of development. Only in the last few years have there been efforts to develop an electrochemical system that can reduce an acceptable amount of carbon dioxide. Research on the laboratory scale has shown that electrolysis of carbon dioxide should preferably be accomplished using metals as catalysts. The publication "Electrochemical $CO_2$ reduction on metal electrodes" by Y. Hori, published in: C. Vayenas, et al. (eds.), Modern Aspects of Electrochemistry, Springer, New York, 2008, p. 89-189, discloses, by way of example, Faraday efficiencies (FE) at different metal cathodes, some of which are shown by way of example in table 1.

TABLE 1

Faraday efficiencies for the conversion of $CO_2$ to various products at various metal electrodes

| Electrode | $CH_4$ | $C_2H_4$ | $C_2H_5OH$ | $C_3H_7OH$ | CO | $HCOO^-$ | $H_2$ | Total |
|---|---|---|---|---|---|---|---|---|
| Cu | 33.3 | 25.5 | 5.7 | 3.0 | 1.3 | 9.4 | 20.5 | 103.5 |
| Au | 0.0 | 0.0 | 0.0 | 0.0 | 87.1 | 0.7 | 10.2 | 98.0 |
| Ag | 0.0 | 0.0 | 0.0 | 0.0 | 81.5 | 0.8 | 12.4 | 94.6 |
| Zn | 0.0 | 0.0 | 0.0 | 0.0 | 79.4 | 6.1 | 9.9 | 95.4 |
| Pd | 2.9 | 0.0 | 0.0 | 0.0 | 28.3 | 2.8 | 26.2 | 60.2 |
| Ga | 0.0 | 0.0 | 0.0 | 0.0 | 23.2 | 0.0 | 79.0 | 102.0 |
| Pb | 0.0 | 0.0 | 0.0 | 0.0 | 0.0 | 97.4 | 5.0 | 102.4 |
| Hg | 0.0 | 0.0 | 0.0 | 0.0 | 0.0 | 99.5 | 0.0 | 99.5 |
| In | 0.0 | 0.0 | 0.0 | 0.0 | 2.1 | 94.9 | 3.3 | 100.3 |
| Sn | 0.0 | 0.0 | 0.0 | 0.0 | 7.1 | 88.4 | 4.6 | 100.1 |
| Cd | 1.3 | 0.0 | 0.0 | 0.0 | 13.9 | 78.4 | 9.4 | 103.0 |
| Tl | 0.0 | 0.0 | 0.0 | 0.0 | 0.0 | 95.1 | 6.2 | 101.3 |
| Ni | 1.8 | 0.1 | 0.0 | 0.0 | 0.0 | 1.4 | 88.9 | 92.4 |
| Fe | 0.0 | 0.0 | 0.0 | 0.0 | 0.0 | 0.0 | 94.8 | 94.8 |
| Pt | 0.0 | 0.0 | 0.0 | 0.0 | 0.0 | 0.1 | 95.7 | 95.8 |
| Ti | 0.0 | 0.0 | 0.0 | 0.0 | 0.0 | 0.0 | 99.7 | 99.7 |

Table 1 states Faraday efficiencies (FE) (in [%]) of products formed in carbon dioxide reduction at various metal electrodes. The values reported are applicable to a 0.1 M potassium hydrogencarbonate solution as electrolyte. As apparent from table 1, the electrochemical reduction of $CO_2$ at solid-state electrodes in aqueous electrolyte solutions offers a multitude of possible products.

There are currently discussions about the electrification of the chemical industry. This means that chemical commodities or fuels are to be produced preferentially from $CO_2$ and/or CO and/or $H_2O$ with supply of surplus electrical energy, preferably from renewable sources. In the phase of introduction of such technology, the aim is for the economic value of a substance to be significantly greater than its calorific value.

Electrolysis methods have undergone significant further development in the last few decades. PEM (proton exchange membrane) water electrolysis has been optimized to give high current densities. Large electrolyzers having outputs in the megawatt range are already being introduced onto the market. For $CO_2$ electrolysis, however, such a further development is found to be more difficult, especially with regard to mass transfer and long operating times.

SUMMARY

The teachings of the present disclosure describe an electrolysis cell or electrolysis system that enables efficient mass transfer and long operating times and can especially avoid salt encrustation at a cathode. For example, some embodiments include an electrolysis cell comprising: a cathode space comprising a cathode; a first ion exchange membrane that contains an anion exchanger and that adjoins the cathode space; an anode space comprising an anode; and a second ion exchange membrane that contains a cation exchanger and that adjoins the anode space; further comprising a salt bridge space, where the salt bridge space is disposed between the first ion exchange membrane and the second ion exchange membrane, wherein the cathode takes the form of a gas diffusion electrode, of a porous bound catalyst structure, of a particulate catalyst on a support, of a coating of a particulate catalyst on the first and/or second ion exchange membrane, of a porous conductive support impregnated with a catalyst, and/or of a noncontinuous two-dimensional structure, containing an anion exchange material, and/or wherein the anode takes the form of a gas diffusion electrode, of a porous bound catalyst structure, of a particulate catalyst on a support, of a coating of a particulate catalyst on the first and/or second ion exchange membrane, of a porous conductive support impregnated with a catalyst, and/or of a noncontinuous two-dimensional structure, containing a cation exchange material.

In some embodiments, the cathode is in contact with the first ion exchange membrane.

In some embodiments, the anode is in contact with the second ion exchange membrane.

In some embodiments, the second ion exchange membrane takes the form of a bipolar membrane, preferably with an anion exchange layer of the bipolar membrane directed toward the anode space and a cation exchange layer of the bipolar membrane directed toward the salt bridge space.

In some embodiments, the first ion exchange membrane and/or the second ion exchange membrane is hydrophilic.

In some embodiments, the anode and/or the cathode is in contact with a conductive structure on the side remote from the salt bridge space.

As another example, some embodiments include an electrolysis system comprising an electrolysis cell as described above.

In some embodiments, there is a recycling unit which is connected to an outlet from the salt bridge space and an inlet into the cathode space and which is set up to conduct a reactant from the cathode reaction that can be formed in the salt bridge space back into the cathode space.

As another example, some embodiments include a method of electrolysis of $CO_2$, wherein an electrolysis cell or an electrolysis system as described above is used, wherein $CO_2$ is reduced at the cathode and hydrogencarbonate formed at the cathode migrates through the first ion exchange membrane to an electrolyte in the salt bridge space.

In some embodiments, the salt bridge space comprises a hydrogencarbonate-containing electrolyte.

In some embodiments, the electrolyte in the salt bridge space does not comprise any acid.

In some embodiments, the anode space does not contain any hydrogencarbonate.

In some embodiments, an anode gas and $CO_2$ are released separately.

As another example, some embodiments include use of an electrolysis cell or of an electrolysis system as described above for electrolysis of $CO_2$.

BRIEF DESCRIPTION OF THE DRAWING

The appended drawings are intended to illustrate embodiments of the present teachings and impart further understanding thereof. In connection with the description, they serve to elucidate concepts and principles of the teachings. Other embodiments and many of the advantages mentioned are apparent with regard to the drawings. The elements of the drawings are not necessarily shown true to scale with respect to one another. Elements, features and components that are the same, have the same function and the same effect are each given the same reference numerals in the figures of the drawings, unless stated otherwise.

In addition.

DETAILED DESCRIPTION

Figure 1:
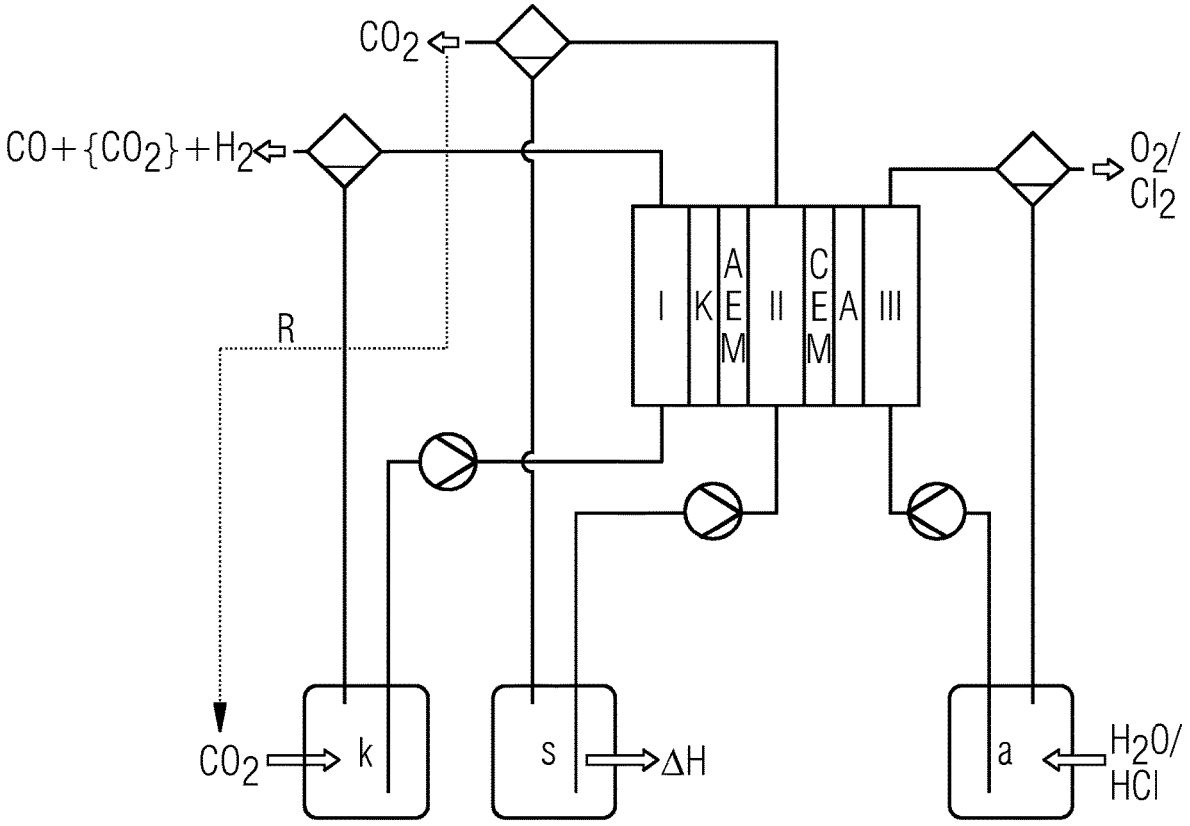
FIGS. 1 to 3 show, in schematic form, examples of electrolysis systems with electrolysis cells incorporating teachings of the present disclosure.

The electrolyzer concept set out here constitutes a possible setup for $CO_2$ electrolysis which is specifically designed to avoid salt encrustation at the cathode and $CO_2$ contamination of the anode offgas. It is thus optimized for efficient mass transfer and long operating times. For this purpose, the inventors have developed concepts designed to specifically suppress known failure mechanisms. At the same time, the constructions disclosed here enable the use of highly conductive electrolytes, which contributes to an improvement in energy efficiency and space-time yield.

Some embodiments include an electrolysis cell comprising:

- a cathode space comprising a cathode;
- a first ion exchange membrane that contains an anion exchanger and that adjoins the cathode space;
- an anode space comprising an anode; and
- a second ion exchange membrane that contains a cation exchanger and that adjoins the anode space; further comprising a salt bridge space, where the salt bridge space is disposed between the first ion exchange membrane and the second ion exchange membrane.

Some embodiments include an electrolysis system comprising the electrolysis cell described above, a method of electrolysis of $CO_2$, wherein an electrolysis cell of the invention or an electrolysis system of the invention is used, wherein $CO_2$ is reduced at the cathode and hydrogencarbonate formed at the cathode migrates through the first ion exchange membrane to the salt bridge space, and to the use of the electrolysis cell or of the electrolysis system for electrolysis of $CO_2$.

Definitions

Unless defined differently, technical and scientific expressions used herein have the same meaning as commonly understood by a person skilled in the art in the technical field of the invention.

Gas diffusion electrodes (GDEs) are electrodes in which liquid, solid and gaseous phases are present, and where, in particular, a conductive catalyst catalyzes an electrochemical reaction between the liquid phase and the gaseous phase.

In the context of the present disclosure, "hydrophobic" means water-repellent. According to the invention, hydrophobic pores and/or channels are thus those that repel water. In particular, hydrophobic properties are associated with substances or molecules having nonpolar groups. By contrast, "hydrophilic" means the ability to interact with water and other polar substances.

In the application, figures are given in % by weight, unless stated otherwise or apparent from the context.

Standard pressure is 101 325 Pa=1.01325 bar.

Basic Anode Reaction:

A basic anode reaction in the context of the disclosure is an anodic half-reaction that releases cations that are not protons or deuterons. Examples are the anodic breakdown of KCl or of KOH:

$$2KCl \rightarrow 2e^- + Cl_2 + 2K^+$$

$$2KOH \rightarrow 4e^- + O_2 + 2H_2O + 4K^+$$

Acidic Anode Reaction:

An acidic anode reaction in the context of the disclosure is an anodic half-reaction that releases protons or deuterons. Examples are the anodic breakdown of HCl or of $H_2O$:

$$2HCl \rightarrow 2e^- + Cl_2 + 2H^+$$

$$2H_2O \rightarrow 4e^- + O_2 + 4H^+$$

In addition, the following terms are defined for a better understanding:

Electroosmosis means an electrodynamic phenomenon in which a force toward the cathode acts on particles having a positive zeta potential that are present in solution and a force toward the anode on all particles having negative zeta potential. If conversion takes place at the electrodes, i.e. a galvanic current flows, there is also a flow of matter of the particles having a positive zeta potential to the cathode, irrespective of whether or not the species is involved in the conversion. The same is true of a negative zeta potential and the anode. If the cathode is porous, the medium is also pumped through the electrode. This is also referred to as an electroosmotic pump.

The flows of matter resulting from electroosmosis can also flow counter to concentration gradients. Diffusion-related flows that compensate for the concentration gradients can be overcompensated as a result. The flows of matter caused by the electroosmosis, especially in the case of porous electrodes, can lead to flooding of regions that could not be filled by the electrolyte without an applied potential. Therefore, this phenomenon can contribute to failure of porous electrodes, especially of gas diffusion electrodes.

Some embodiments include an electrolysis cell comprising:

a cathode space comprising a cathode;

a first ion exchange membrane that contains an anion exchanger and that adjoins the cathode space;

an anode space comprising an anode; and a second ion exchange membrane that contains a cation exchanger and that adjoins the anode space;

further comprising a salt bridge space, where the salt bridge space is disposed between the first ion exchange membrane and the second ion exchange membrane.

In the electrolysis cell described above, the cathode space, the cathode, the first ion exchange membrane that contains an anion exchanger and that adjoins the cathode space, the anode space, the anode, the second ion exchange membrane that contains a cation exchanger and that adjoins the anode space, and the salt bridge space are not particularly restricted, provided that these constituents have the appropriate arrangement in the electrolysis cell. More particularly, the salt bridge space is bounded here by the first ion exchange membrane and the second ion exchange membrane, and is additionally especially not directly connected to the anode space, the anode, the cathode space and the cathode, such that there is mass transfer between the salt bridge space and the cathode space or the cathode only via the first ion exchange membrane, and between the salt bridge space and the anode space or the anode only via the second ion exchange membrane.

In some embodiments, the cathode space, the anode space and the salt bridge space are not particularly restricted with regard to shape, material, dimensions, etc., provided that they can accommodate the cathode, the anode and the first and second ion exchange membranes. The three spaces may be formed, for example, within a common cell, in which case they may be separated correspondingly by the first and second ion exchange membranes. For the individual spaces, it is possible here, according to the electrolysis to be conducted, to provide respective inlet and outlet devices for reactants and products, for example in the form of liquid, gas, solution, suspension, etc., each of which may optionally also be recycled. There is no restriction in this regard either, and the flow through the individual spaces may be in parallel flows or in countercurrent.

For example, in an electrolysis of $CO_2$—where this may also contain CO, i.e., for example, contains at least 20% by volume of $CO_2$—this may be supplied to the cathode in solution, as a gas, etc., for example in countercurrent to an electrolyte in the salt bridge space. There is no restriction in this regard. Corresponding supply options also exist in the anode space and will also be set out in more detail hereinafter. The respective feed may be provided either in continuous form or, for example, pulsed form, etc., for which pumps, valves, etc. may correspondingly be provided in an electrolysis system, and also cooling and/or heating devices in order to be able to catalyze reactions that are accordingly desired at the anode and/or cathode. The materials of the respective spaces or of the electrolysis cell and/or of the further constituents of the electrolysis system may also be suitably matched here in accordance with desired reactions, reactants, products, electrolytes, etc. Furthermore, at least one power source per electrolysis cell is of course also included. Further apparatus parts that occur in electrolysis systems may also be provided in the electrolysis system or the electrolysis cell.

In some embodiments, the cathode is not particularly restricted and may be matched to a desired half-reaction, for example with regard to the reaction products. For example, a cathode for reduction of $CO_2$ and optionally CO may comprise a metal such as Cu, Ag, Au, Zn, etc. and/or a salt thereof, where suitable materials may be matched to a desired product. The catalyst may thus be chosen according to the desired product. In the case of the reduction of $CO_2$ to CO, for example, the catalyst is preferably based on Ag, Au, Zn and/or compounds thereof, such as $Ag_2O$, AgO, $Au_2O$, $Au_2O_3$, ZnO. For preparation of hydrocarbons, preference is given to Cu or Cu-containing compounds such as $Cu_2O$, CuO and/or copper-containing mixed oxides with other metals, etc.

The cathode is the electrode at which the reductive half-reaction takes place. It may take the form of a gas diffusion electrode, porous electrode or solid electrode, etc.

Figure 4:
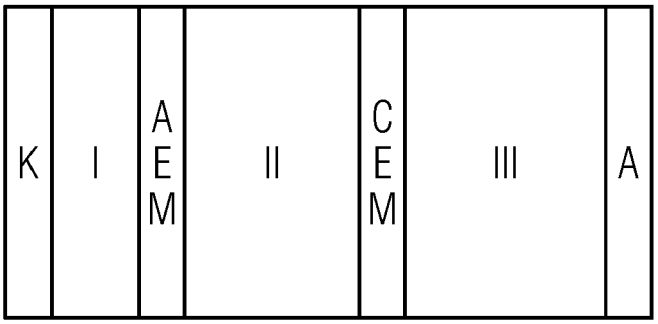
FIG. 4 shows, in schematic form, a further example of an electrolysis cell incorporating teachings of the present disclosure.

The following embodiments, for example, are possible here:

- gas diffusion electrode or porous bound catalyst structure which, in particular embodiments, may be bonded to the first ion exchange membrane, for example an anion exchange membrane (AEM), by means of a suitable ionomer, for example an anionic ionomer;
- gas diffusion electrode or porous bound catalyst structure which, in particular embodiments, may have been embedded partially into the first ion exchange membrane, for example an AEM;
- particulate catalyst that has been applied by means of a suitable ionomer to a suitable support, for example a porous conductive support and, in particular embodiments, may adjoin the first ion exchange membrane, for example an AEM;
- particulate catalyst that has been pressed into the first ion exchange membrane, for example an AEM, and connected, for example, in a correspondingly conductive manner;
- noncontinuous two-dimensional structure, for example a mesh or an expanded metal that, for example, consists of or comprises or has been coated with a catalyst and, in particular embodiments, adjoins the first ion exchange membrane, for example an AEM;
- solid electrode, in which case there may also be a gap between the first ion exchange membrane, for example an AEM, and the cathode, as shown in FIG. 4 for example, although this is not preferred;
- porous conductive support that has been impregnated with a suitable catalyst and optionally an ionomer and, in particular embodiments, adjoins the first ion exchange membrane, for example an AEM;
- non-ion-conductive gas diffusion electrode that has subsequently been impregnated with a suitable ionomer, for example an anion-conductive ionomer, and, in particular embodiments, adjoins the first ion exchange membrane, for example an AEM.

The corresponding cathodes here may also contain materials that are customary in cathodes, such as binders, ionomers, for example anion-conductive ionomers, fillers, hydrophilic additives, etc., which are not particularly restricted. As well as the catalyst, the cathode may thus, in particular embodiments, contain at least one ionomer, for example an anion-conductive ionomer (e.g. anion exchange resin that may comprise, for example, various functional groups for ion exchange, which may be the same or different, for example tertiary amine groups, alkylammonium groups and/or phosphonium groups), a support material, for example a conductive support material (for example a metal such as titanium), and/or at least one nonmetal such as carbon, Si, boron nitride (BN), boron-doped diamond, etc., and/or at least one conductive oxide such as indium tin oxide (ITO), aluminum zinc oxide (AZO) or fluorinated tin oxide (FTO)—for example for production of photoelectrodes, and/or at least one polymer based on polyacetylene, polyethoxythiophene, polyaniline or polypyrrole, for example in polymer-based electrodes; nonconductive supports, for example polymer meshes are possible, for example, in the case of adequate conductivity of the catalyst layer, binders (e.g. hydrophilic and/or hydrophobic polymers, for example organic binders, for example selected from PTFE (polytetrafluoroethylene), PVDF (polyvinylidene difluoride), PFA (perfluoroalkoxy polymers), FEP (fluorinated ethylene-propylene copolymers), PFSA (perfluorosulfonic acid polymers), and mixtures thereof, especially PTFE), conductive fillers (e.g. carbon), nonconductive fillers (e.g. glass) and/or hydrophilic additives (e.g. $Al_2O_3$, $MgO_2$, hydrophilic materials such as polysulfones, e.g. polyphenylsulfones, polyimides, polybenzoxazoles or polyetherketones, or generally polymers that are electrochemically stable in the electrolyte, polymerized "ionic liquids", and or organic conductors such as PEDOT:PSS or PANI (camphorsulfonic acid-doped polyaniline), which are not particularly restricted.

The cathode, especially in the form of a gas diffusion electrode, in particular embodiments, contains an ion-conductive component, especially an anion-conductive component. Other cathode forms are also possible, for example cathode constructions as described in US2016 0251755-A1 and U.S. Pat. No. 9,481,939.

The anode is not particularly restricted either and may be matched to a desired half-reaction, for example with regard to the reaction products. At the anode, which is electrically connected to the cathode by means of a power source for provision of the potential for the electrolysis, the oxidation of a substance takes place in the anode space. In addition, the anode material is not particularly restricted and depends primarily on the desired reaction. Illustrative anode materials include platinum or platinum alloys, palladium or palladium alloys, and glassy carbon. Further anode materials are also conductive oxides such as doped or undoped $TiO_2$, indium tin oxide (ITO), fluorine-doped tin oxide (FTO), aluminum-doped zinc oxide (AZO), iridium oxide, etc. These catalytically active compounds may optionally also merely have been superficially applied by thin-film methodology, for example on a titanium and/or carbon support. The anode catalyst is not particularly restricted. The catalyst used for $O_2$ or $Cl_2$ production may, for example, also be $IrO_x$ ($1.5<x<2$) or $RuO_2$. These may also take the form of a mixed oxide with other metals, e.g. $TiO_2$, and/or be supported on a conductive material such as C (in the form of conductive black, activated carbon, graphite, etc.). Alternatively, it is also possible to utilize catalysts based on Fe—Ni or Co—Ni for generation of $O_2$. For this purpose, for example, the construction described below with bipolar membrane is suitable.

The anode is the electrode at which the oxidative half-reaction takes place. It may likewise take the form of a gas diffusion electrode, porous electrode or solid electrode, etc.

Figure 3:
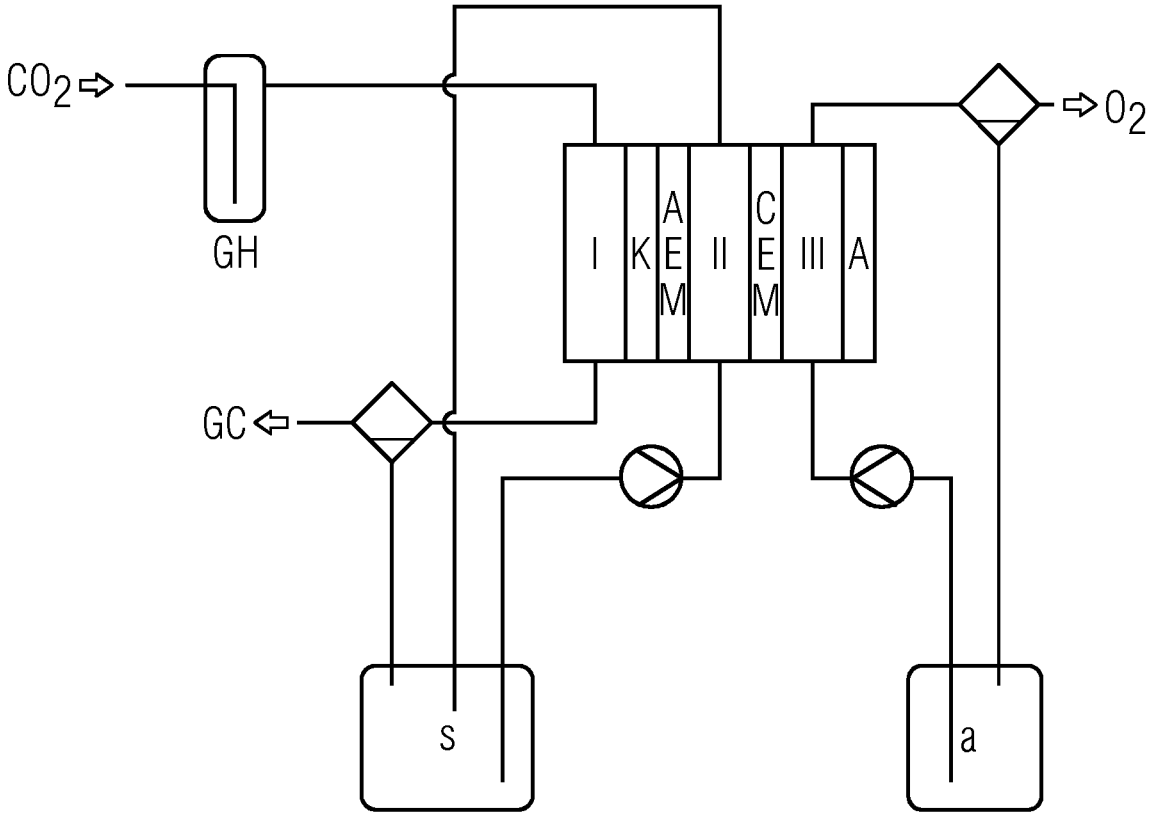

The following embodiments are possible:

- gas diffusion electrode or porous bound catalyst structure which, in particular embodiments, may be bonded to the second ion exchange membrane, for example a cation exchange membrane (CEM), by means of a suitable ionomer, for example a cationic ionomer;
- gas diffusion electrode or porous bound catalyst structure which, in particular embodiments, may have been embedded partially into the second ion exchange membrane, for example a CEM;
- particulate catalyst that has been applied by means of a suitable ionomer to a suitable support, for example a porous conductive support and, in particular embodiments, may adjoin the second ion exchange membrane, for example a CEM;

particulate catalyst that has been pressed into the second ion exchange membrane, for example a CEM, and connected, for example, in a correspondingly conductive manner;

noncontinuous two-dimensional structure, for example a mesh or an expanded metal that, for example, consists of or comprises or has been coated with a catalyst and, in particular embodiments, adjoins the second ion exchange membrane, for example a CEM;

solid electrode, in which case there may also be a gap between the second ion exchange membrane, for example a CEM, and the anode, as shown in FIGS. 3 and 4 for example, although this is not preferred;

porous conductive support that has been impregnated with a suitable catalyst and optionally an ionomer and, in particular embodiments, adjoins the second ion exchange membrane, for example a CEM;

non-ion-conductive gas diffusion electrode that has subsequently been impregnated with a suitable ionomer, for example a cation-conductive ionomer, and, in particular embodiments, adjoins the second ion exchange membrane, for example a CEM.

The corresponding anodes may also contain materials that are customary in anodes, such as binders, ionomers, for example including cation-conductive ionomers, for example containing tertiary amine groups, alkylammonium groups and/or phosphonium groups, fillers, hydrophilic additives, etc., which are not particularly restricted, and which, for example, are also described above with regard to the cathodes. In some embodiments, the electrodes mentioned above by way of example may be combined with one another as desired.

The first ion exchange membrane that contains an anion exchanger and adjoins the cathode space is not particularly restricted. It may contain, for example, an anion exchanger in the form of an anion exchange layer, in which case further layers such as non-ion-conductive layers may be present. In particular embodiments, the first ion exchange membrane is an anion exchange membrane, i.e., for example, an ion-conductive membrane (or in the broader sense a membrane having a cation exchange layer) having positively charged functionalizations, which is not particularly restricted. In some embodiments, charge transport takes place in the anion exchange layer or an anion exchange membrane via anions. More particularly, the first ion exchange membrane and especially the anion exchange layer or anion exchange membrane therein serves to provide for anion transport across positive charges at fixed locations. In this case, it is especially possible to reduce or completely avoid the penetration of electrolyte into the cathode which is promoted by electroosmotic forces.

In some embodiments, a first ion exchange membrane, for example anion exchange membrane, in particular embodiments, shows good wettability by water and/or aqueous salt solutions, high ion conductivity and/or tolerance of the functional groups present therein to high pH values, especially does not show any Hoffman elimination. An example of an AEM in accordance with the invention is the A201-CE membrane, sold by Tokuyama, which is used in the example, the "Sustainion" sold by Dioxide Materials, or an anion exchange membrane sold by Fumatech, for example Fumasep FAS-PET or Fumasep FAD-PET.

In some embodiments, a second ion exchange membrane, for example a cation exchange membrane or a bipolar membrane, contains a cation exchanger that may be in contact with the electrolyte in the salt bridge space. Otherwise, the second ion exchange membrane that contains a cation exchanger and that adjoins the anode space is not particularly restricted. It may contain, for example, a cation exchanger in the form of a cation exchange layer, in which case further layers such as non-ion-conductive layers may be present. It may likewise take the form of a bipolar membrane or of a cation exchange membrane (CEM). The cation exchange membrane or cation exchange layer is, for example, an ion-conductive membrane or ion-conductive layer with negatively charged functionalizations. A preferred mode of charge transport in the salt bridge takes place in the second ion exchange membrane via cations. For example, commercially available Nafion® membranes are suitable as CEM, or else the Fumapem-F membranes sold by Fumatech, Aciplex sold by Asahi Kasei, or the Flemion membranes sold by AGC. In principle, it is alternatively possible to use other polymer membranes modified with strongly acidic groups (groups such as sulfonic acid, phosphonic acid).

In some embodiments, the second ion exchange membrane prevents the passage of anions, especially $HCO_3^-$, into the anode space. The text that follows assumes the simpler case of the CEM for the second ion exchange membrane if it is not explicitly identified as a bipolar membrane.

In some embodiments, a second ion exchange membrane, for example cation exchange membrane, in particular embodiments, shows good wettability by water and aqueous salt solutions, high ion conductivity, stability to reactive species that can be generated at the anode (as is the case, for example, for perfluorinated polymers), and/or stability in the pH regime required, according to the anode reaction.

In particular embodiments, the first ion exchange membrane and/or the second ion exchange membrane is hydrophilic. In particular embodiments, the anode and/or cathode is at least partly hydrophilic. In particular embodiments, the first ion exchange membrane and/or the second ion exchange membrane is wettable with water. In order to assure good ion conductivity of the ionomers, swelling with water is preferred. In the experiment, it has been found that membranes of limited wettability can lead to a distinct deterioration in the ionic connection of the electrodes.

For some of the electrochemical conversions at the catalyst electrodes too, the presence of water may be useful.

$$\text{e.g. } 3CO_2+H_2O+2e^- \rightarrow CO+2HCO_3^-$$

Therefore, the anode and/or cathode, in particular embodiments, have sufficient hydrophilicity. This can optionally be adjusted via hydrophilic additions such as $TiO_2$, $Al_2O_3$, or other electrochemically inert metal oxides, etc.

The salt bridge space, as described above, is not particularly restricted, provided that it is disposed between the first ion exchange membrane and the second ion exchange membrane.

In particular embodiments, the cathode and/or the anode takes the form of a gas diffusion electrode, of a porous bound catalyst structure, of a particulate catalyst on a support, of a coating of a particulate catalyst on the first and/or second ion exchange membrane, of a porous conductive support impregnated with a catalyst, and/or of a noncontinuous two-dimensional structure. In particular embodiments, the cathode takes the form of a gas diffusion electrode, of a porous bound catalyst structure, of a particulate catalyst on a support, of a coating of a particulate catalyst on the first and/or second ion exchange membrane, of a porous conductive support impregnated with a catalyst, and/or of a noncontinuous two-dimensional structure, containing an anion exchange material. In particular embodiments, the anode takes the form of a gas diffusion electrode, of a porous bound catalyst structure, of a particulate catalyst on a support, of a coating of a particulate catalyst on the first and/or second ion exchange membrane, of a porous conductive support impregnated with a catalyst, and/or of a noncontinuous two-dimensional structure, containing a cation exchange material. The various embodiments of the cathode and anode can be combined with one another as desired.

Figure 2:
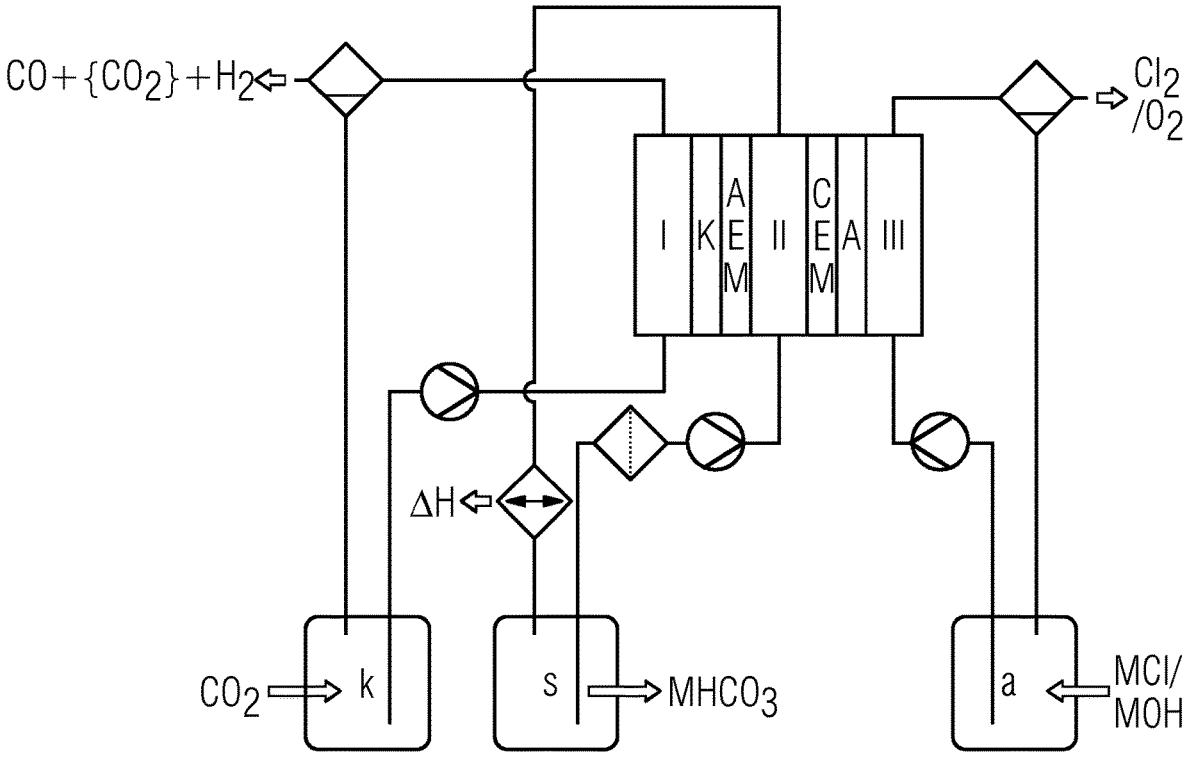

Examples of different modes of operation of a double membrane cell are shown in FIGS. 1 to 4—in FIGS. 1 to 3 also in conjunction with further constituents of an electrolysis systems, also with regard to the methods. In the figures, by way of example, reduction of $CO_2$ to CO is assumed. In principle, however, the method is not restricted to this reaction, but can also be used for any other products, such as hydrocarbons, preferably gaseous hydrocarbons.

FIG. 1 shows, by way of example, a 2-membrane construction for $CO_2$ electroreduction with an acidic anode reaction, FIG. 2 a 2-membrane construction for $CO_2$ electroreduction with a basic anode reaction, and FIG. 3 an experimental setup for a double membrane cell as also used in example 1. In each of these figures, the cathode K is provided in the cathode space I and the anode A in the anode space III, with a salt bridge space II formed between these spaces, which is separated from the cathode space I by a first membrane, here as AEM, and from the anode space III by a second membrane, here as CEM.

FIG. 4 additionally shows a further construction of an electrolysis cell in which both the first ion exchange membrane in the form of an anion exchange membrane AEM and the second ion exchange membrane in the form of a cation exchange membrane CEM are not in direct contact with the cathode K or with the anode A. In such an embodiment, it is possible, for example, for the cathode and the anode to take the form of a solid electrode. The electrolysis cell shown in FIG. 4 may likewise be used in the electrolysis systems shown in FIGS. 1 to 3. It is also possible for the different half-cells from FIGS. 1 to 3, and also the corresponding arranged constituents of the electrolysis system to be combined as desired, and likewise with other electrolysis half-cells (not shown).

More detailed descriptions of FIGS. 1 to 4 are given hereinafter in conjunction with the methods. In particular embodiments, the second ion exchange membrane takes the form of a bipolar membrane, wherein an anion exchange layer of the bipolar membrane may be directed toward the anode space and a cation exchange layer of the bipolar membrane toward the salt bridge space. This may be especially useful in the case of use of aqueous electrolytes, as discussed hereinafter.

Figure 5:
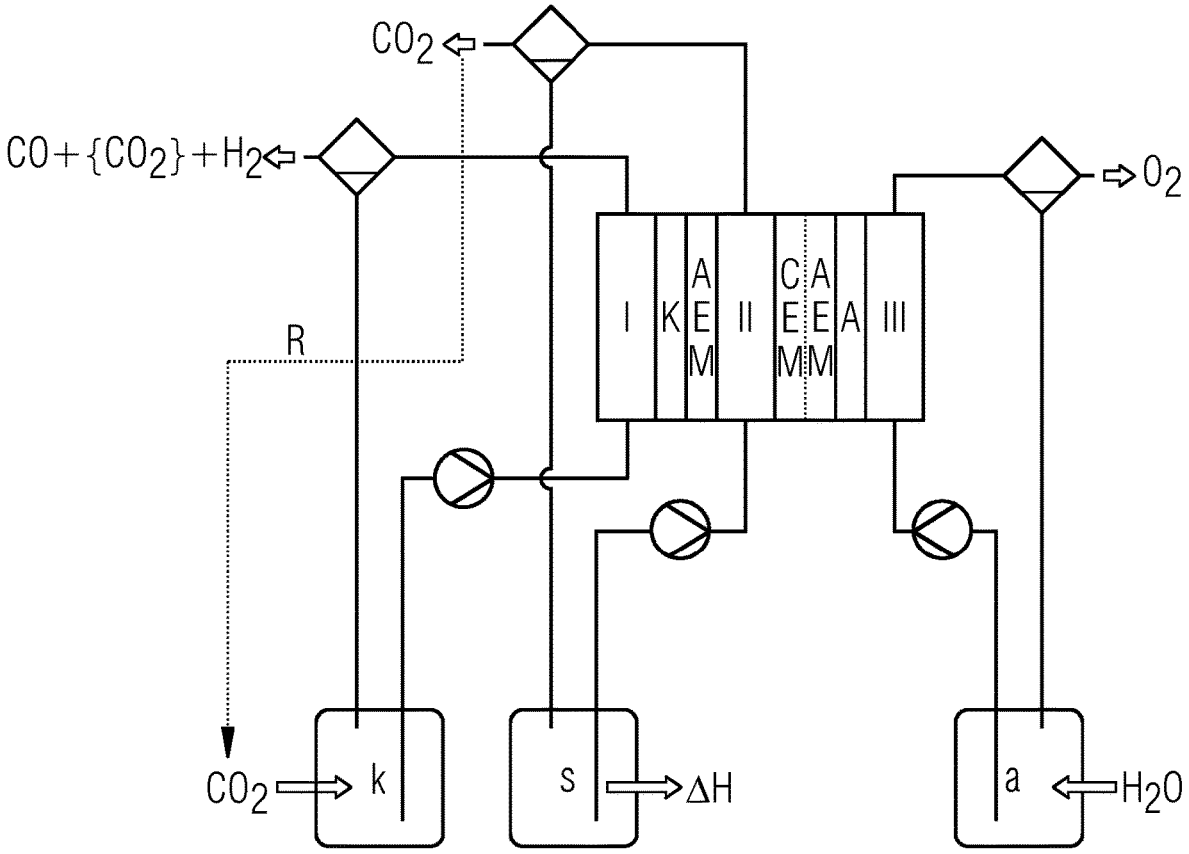
FIG. 5 shows, in schematic form, a further example of an electrolysis system with an electrolysis cell incorporating teachings of the present disclosure.

Such an illustrative specific construction with bipolar membrane is shown in FIG. 5, which shows, by way of example, a 2-membrane construction for $CO_2$ electroreduction with AEM on the cathode side and bipolar membrane (CEM/AEM) on the anode side, showing here, as in FIGS. 1 to 3 as well, the supply of catholyte k, salt bridge s (electrolyte for the salt bridge space) and anolyte a, and also recycling R of $CO_2$, and where there is an oxidation of water by way of example on the anode side. The further reference numerals correspond to those in FIGS. 1 to 4.

In a double membrane cell, there is thus also a possible construction in which the second ion exchange membrane used is a bipolar membrane. A bipolar membrane is, for example, a sandwich composed of a CEM and an AEM. But this typically does not comprise two membranes laid one on top of the other, but rather a membrane having at least two layers. The diagram in FIGS. 5 and 6 with AEM and CEM serves here merely for illustration of the preferred orientation of the layers. The AEM or anion exchange layer faces the anode here; the CEM or cation exchange layer faces the cathode. These membranes are virtually impassable both to anions and cations. The conductivity of a bipolar membrane is accordingly not based on transport capacity for ions. Instead, the ions are transported typically via acid-base disproportionation of water in the middle of the membrane. This generates two charge carriers of opposite charge that are transported away by the electrical field.

The $OH^-$ ions thus generated can be guided through the AEM portion of the bipolar membrane to the anode, where they are oxidized:

$$4OH^- \rightarrow O_2 + 2H_2O + 4e^-$$

and the "H+" ions can be guided through the CEM portion of the bipolar membrane into the salt bridge or salt bridge space II, where they can be neutralized by the cathodically generated $HCO_3^-$ ions.

$$HCO_3^- + H^+ \rightarrow CO_2 + H_2O$$

Since the conductivity of the bipolar membrane is based on the separation of charges in the membrane, however, a higher potential drop is typically to be expected.

In such a construction there may be decoupling of the electrolyte circuits since, as already mentioned, the bipolar membrane is virtually impermeable to all ions. In this way, for a basic anode reaction as well, it is possible to implement a construction that does not need constant replenishment and removal of salts or anode products. This is otherwise possible only in the case of use of anolytes based on acids having electrochemically inactive anions, for example $H_2SO_4$. In the case of use of a bipolar membrane, it is also possible to use hydroxide electrolytes such as KOH or NaOH. High pH values thermodynamically promote the oxidation of water and permit the use of much more favorable anode catalysts, for example based on iron-nickel, that would not be stable under acidic conditions.

Figure 6:
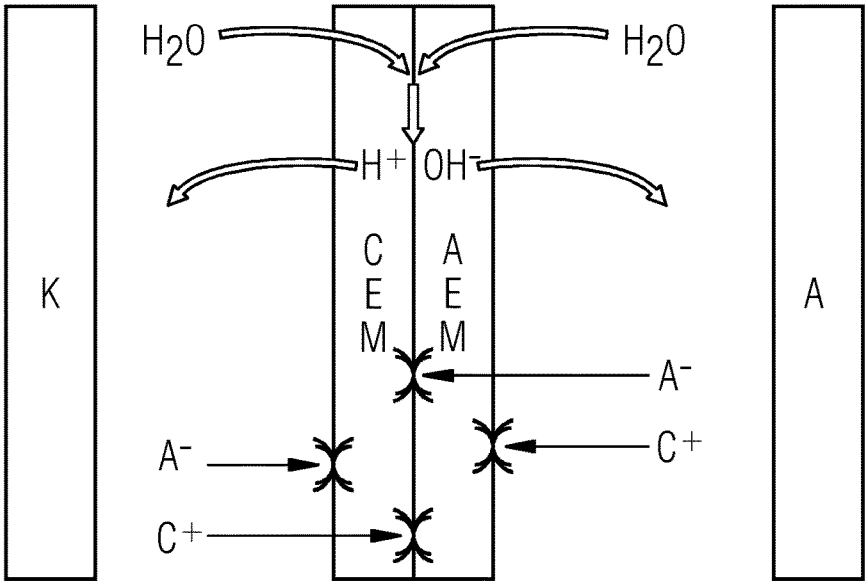
FIG. 6 is a schematic diagram to illustrate the mode of function of a bipolar membrane.

FIG. 6 shows, in detail, a diagram for illustration of the mode of function of a bipolar membrane with the blocking of anions $A^-$ and cations $C^+$.

In particular embodiments, the anode is in contact with the second ion exchange membrane and/or, in particular embodiments, the cathode is in contact with the first ion exchange membrane, as already described by way of example above. This enables good connection to the salt bridge space. It is also possible to reduce or even avoid electrical shadowing effects.

The avoidance of electrical shadowing effects can be elucidated here as follows. Efficient operation of an electrolysis cell typically requires both electrical connection and ionic connection of the electrochemically active catalyst. This can be effected, for example, via partial penetration of the electrode by an electrolyte. This can be ensured, for example, by means of ion-conductive components (ionomers) in the respective electrode or the electrodes. The ionomer in that case virtually constitutes a "fixed" electrolyte.

In particular embodiments of the double membrane cell, both anode and cathode are connected directly to the first and second ion exchange membrane respectively, for example each comprising a polymer electrolyte. This could prevent shadowing effects resulting from mechanical support structures in the electrolyte chambers. If nonconductive support structures directly adjoin the electrochemically active areas, these are insulated from ion transport and are inactive. However, the first and second ion exchange membrane preferably lie over the full area and thus provide ionic connection of the catalyst over the full area.

Figure 7:
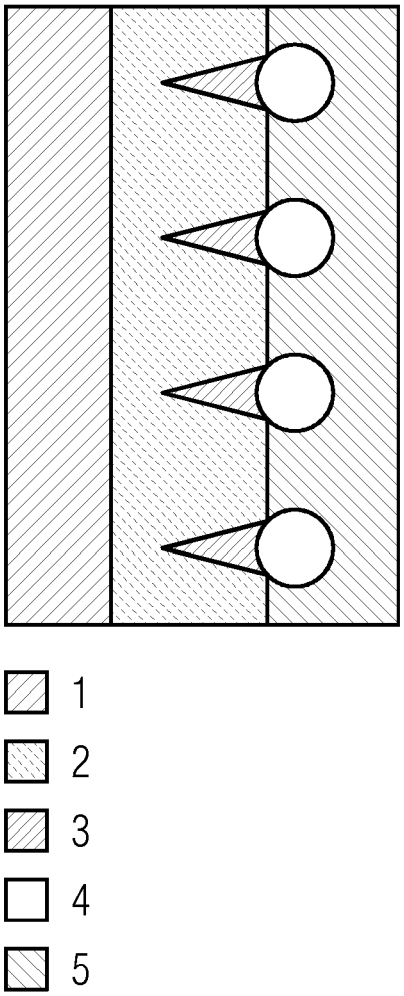
FIGS. 7 and 8 show a graphic illustration of the advantages of a "zero-gap" construction in relation to electrode shadowing by mechanical support structures.
Figure 8:
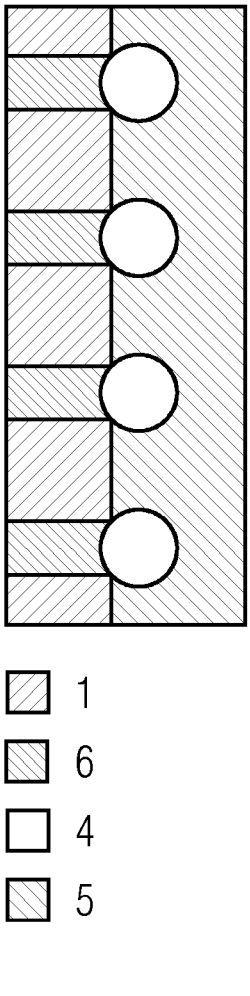

FIGS. 7 and 8 give a graphic illustration of the advantages of such a "zero-gap" construction in relation to the electrode shadowing by mechanical support structures, with FIG. 7 showing the catalyst 1 of the electrode (active) and the mechanical support structure 4, between which the liquid electrolyte 5 in a polymer electrolyte 2 as ion exchange material forms sites in the polymer electrolyte 3 with little ion flow, whereas FIG. 8 shows inactive catalyst 6 at the mechanical support structure 4.

In particular embodiments, the anode and/or the cathode is in contact with a conductive structure on the side remote from the salt bridge space. The conductive structure here is not particularly restricted. The anode and/or the cathode, in particular embodiments, is thus in contact with the side remote from the salt bridge via conductive structures. These are not particularly restricted. These may, for example, be carbon fleeces, metal foams, metal knits, expanded metals, graphite structures or metal structures.

Some embodiments include an electrolysis system comprising the electrolysis cell described above. The corresponding embodiments of the electrolysis cell and also further illustrative components of an electrolysis system of the invention have already been discussed above and are thus also applicable to the electrolysis systems.

In particular embodiments, the electrolysis system further comprises a recycling unit which is connected to an outlet from the salt bridge space and an inlet into the cathode space and which is set up to conduct a reactant from the cathode reaction that can be formed in the salt bridge space back into the cathode space. This is advantageous especially in conjunction with a CEM as second ion exchange membrane in combination with an acidic anode reaction, and in the case of use of a bipolar membrane as second ion exchange membrane.

Some embodiments include a method of electrolysis of $CO_2$, wherein an electrolysis cell or an electrolysis system as described above is used, wherein $CO_2$ is reduced at the cathode and hydrogencarbonate formed at the cathode migrates through the first ion exchange membrane to an electrolyte in the salt bridge space. Any further transfer of this hydrogencarbonate to the anolyte can be suppressed by the second ion exchange membrane.

The electrolysis cell and the electrolysis system are employed in the method for electrolysis of $CO_2$, and therefore aspects that are discussed in connection therewith above and hereinafter also relate to said method. The method may be used to electrolyze $CO_2$, although it is not ruled out that a further reactant such as CO that can likewise be electrolyzed is present as well as $CO_2$ on the cathode side, i.e. there is a mixture comprising $CO_2$ and also, for example, CO. For example, a reactant on the cathode side contains at least 20% by volume of $CO_2$.

In the salt bridge space, there is typically an electrolyte that can ensure electrolytic connection between cathode space and anode space. This electrolyte is also referred to as salt bridge and is not particularly restricted, it may comprise a aqueous solution of salts.

The salt bridge here is thus an electrolyte, e.g. with high ion conductivity, and serves to establish contact between anode and cathode. In particular embodiments, the salt bridge also enables the removal of waste heat. Moreover, the salt bridge serves as reaction medium for the anodically and cathodically generated charge carriers. In particular embodiments, the salt bridge is a solution of one or more salts, also referred to as conductive salts, that are not particularly restricted. In particular embodiments, the salt bridge has a buffer capacity sufficient to suppress variations in pH in operation and the buildup of pH gradients within the cell dimensions. The pH of the 1:1 buffer should preferably be within the neutral range in order to achieve maximum capacity at the neutral pH values that result from the $CO_2$/hydrogencarbonate system. The hydrogenphosphate/dihydrogen-phosphate buffer, for example, would accordingly be suitable, having, for example, a 1:1 pH of 7.2. In addition, some embodiments include using salts in the salt bridge that do not damage the electrodes in the event of trace diffusion through the membranes.

Since the electrodes do not come into direct contact with the salt bridge, the chemical nature of the salt bridge electrolyte is much less restricted than in the case of other cell concepts. For example, it is also possible to use salts that would damage the electrodes, for example halides (chloride, bromides→damage to Ag or Cu cathode; fluorides→damage to Ti anodes) or would be electrochemically converted by the electrodes, for example nitrates or oxalates. Since ion transport into the electrodes can be suppressed, it is also possible to work with higher concentrations. Overall, it is thus possible to assure high conductivity of the salt bridge, which leads to an improvement in energy efficiency.

Furthermore, it is also possible for electrolytes to be present in the anode space and/or cathode space that are also referred to as anolyte or catholyte, but it is not ruled out that there are no electrolytes in the two spaces and, accordingly, these are supplied, for example, solely with liquids or gases for conversion, for example solely $CO_2$, optionally also in a mixture with CO for example, to the cathode and/or water or HCl to the anode. In particular embodiments, an anolyte and/or catholyte are present, which may be the same or different and may differ from or correspond to the salt bridge, for example with regard to conductive salts or solvents present, etc.

A catholyte here is the electrolyte flow around the cathode and serves in particular embodiments to supply the cathode with substrate or reactant. The embodiments which follow, for example, are possible. The catholyte may take the form, for example, of a solution of the substrate ($CO_2$) in a liquid carrier phase (e.g. water), optionally with conductive salts, which are not particularly restricted, or of a mixture of the substrate with other gases (e.g. water vapor+$CO_2$). It is also possible, as described above, for the substrate to take the form of a pure phase, e.g. $CO_2$. If the reaction affords uncharged liquid products, these can be washed out of the catholyte and can subsequently also optionally be removed correspondingly.

An anolyte is an electrolyte flow around the anode and serves in particular embodiments to supply the anode with substrate or reactant and, if appropriate, to transport anode products away. The embodiments that follow are possible by way of example. The anolyte may take the form of a solution of the substrate (e.g. hydrochloric acid=$HCl_{aq}$ or KCl) in a liquid carrier phase (e.g. water), optionally with conductive salts, which are not restricted, or of a mixture of the substrate with other gases (e.g. hydrogen chloride=$HCl_g$+$H_2O$). As also the case for the catholyte, the substrate may alternatively take the form of a pure phase, for example in the form of hydrogen chloride gas=$HCl_g$.

In particular embodiments, the salt bridge and optionally the anolyte and/or catholyte are aqueous electrolytes, optionally with addition of appropriate reactants that are converted at the anode or cathode to the anolyte and/or catholyte. The addition of reactant is not particularly restricted here. For example, $CO_2$ can be added to a catholyte outside the cathode space, or else can be added via a gas diffusion electrode, or else can be supplied solely as a gas to the cathode space. Corresponding considerations are analogously possible for the anode space, according to the reactant used, e.g. water, HCl, etc., and the desired product.

In particular embodiments, the salt bridge space comprises a hydrogencarbonate-containing electrolyte. Hydrogencarbonate may also form here, for example, via a reaction of $CO_2$ and water at the cathode, as will be set out further hereinafter. The hydrogencarbonate may form a salt, for example, in the salt bridge space with cations that are present, e.g. alkali metal cations such as $K^+$. This is the case especially in the case of a basic anode reaction in which the alkali metal cations such as $K^+$ are replenished constantly from the anode space. The hydrogencarbonate salt formed can thus be concentrated up to above the saturation concentration, such that it can be deposited if appropriate in the salt bridge reservoir and can subsequently be removed. An anion exchange layer or an AEM prevents salt encrustation of the cathode. Crystallization of salts in the salt bridge space should preferably stands be avoided. In particular embodiments, the electrolyte may be cooled, for example after leaving the cell, in order to induce crystallization in the reservoir and hence lower its concentration.

In the case of an acidic anode reaction, in particular embodiments, excess hydrogencarbonate in the salt bridge can be broken down by the protons that pass over from the anode space to give $CO_2$ and water.

In particular embodiments, the electrolyte in the salt bridge space does not comprise any acid. In this way, in particular embodiments, the generation of hydrogen at the cathode can be reduced or prevented. The generation of hydrogen can be generated in a more energy-efficient manner by pure hydrogen electrolyzers because the overvoltage is lower. As the case may be, it can be accepted as a by-product.

In particular embodiments, the anode space does not contain any hydrogencarbonate. In this way, it is possible to suppress release of $CO_2$ in the anode space. This can avoid unwanted association of the anode products with $CO_2$. In particular embodiments, an anode gas, i.e. a gaseous anode product, and $CO_2$ are released separately.

Corresponding considerations relating to the salt bridge and to the salt bridge space, to the anode space and to the cathode space and any electrolytes present therein are also elucidated in further detail hereinafter with reference to particular embodiments of the teachings herein.

An electrolysis cell, or a process in which it is used, for example the process for electrolysis of $CO_2$, features the introduction of two ion-selective membranes and a salt bridge space that enables a third electrolyte stream, the salt bridge, bounded by one of the membranes on either side.

Schematic diagrams are given, for example, in FIGS. 1 to 4. The first ion exchange membrane, for example an AEM (anion exchange membrane=AEM) is selective for the transport of anions and protons/deuterons. It is oriented toward the cathode. The other, second ion exchange membrane, e.g. CEM (cation exchange membrane=CEM), is virtually selective for the transport of cations and protons/deuterons. It is oriented toward the anode. This approach reduces or suppresses the electroosmotic migration of cations through the cathode and simultaneously avoids the contamination of the anode space, for example of an anode gas, with $CO_2$ and hence the loss thereof.

Illustrative different modes of operation of a double membrane cell are shown in FIGS. 1 to 4—in FIGS. 1 to 3 also in conjunction with further constituents of an electrolysis system, also with regard to the method. In the figures, by way of example, reduction of $CO_2$ to CO is assumed. In principle, however, the method is not restricted to this reaction, but can also be used for any other products, e.g. gaseous products.

FIG. 1 shows, by way of example, a 2-membrane construction for $CO_2$ electroreduction with an acidic anode reaction, FIG. 2 a 2-membrane construction for $CO_2$ electroreduction with a basic anode reaction, and FIG. 3 an experimental setup for a double membrane cell as also used in example 1. FIG. 4 additionally shows a further construction of an electrolysis cell in which both the first ion exchange membrane that takes the form of an anion exchange membrane AEM and the second anion exchange membrane that takes the form of a cation exchange membrane CEM are not in direct contact with the cathode K or with the anode A. In such an embodiment, it is possible, for example, for the cathode and the anode to take the form of a solid electrode. The electrolysis cells shown in FIG. 4 may likewise be used in the electrolysis systems shown in FIGS. 1 to 3. It is also possible for the different half-cells from FIGS. 1 to 3, and also the corresponding arranged constituents of the electrolysis system, to be combined with one another as desired, and likewise also with other electrolysis half-cells (not shown).

In FIGS. 1 to 4 and also FIGS. 5, 6 and 9 to 12, the reference numerals used have the following meaning here:

I: cathode space or catholyte chamber in the cell;
II: salt bridge space or salt bridge chamber in the cell;
III: anode space or anolyte chamber in the cell;
K: cathode;
A: anode;
AEM: anion exchange membrane or anion exchange layer;
CEM: cation exchange membrane or cation exchange layer;
k: catholyte
a: anolyte
s: salt bridge
R: $CO_2$ recycling
GH: gas humidifier
GC: gas chromatography (specifically for example 1)

Figure 11:
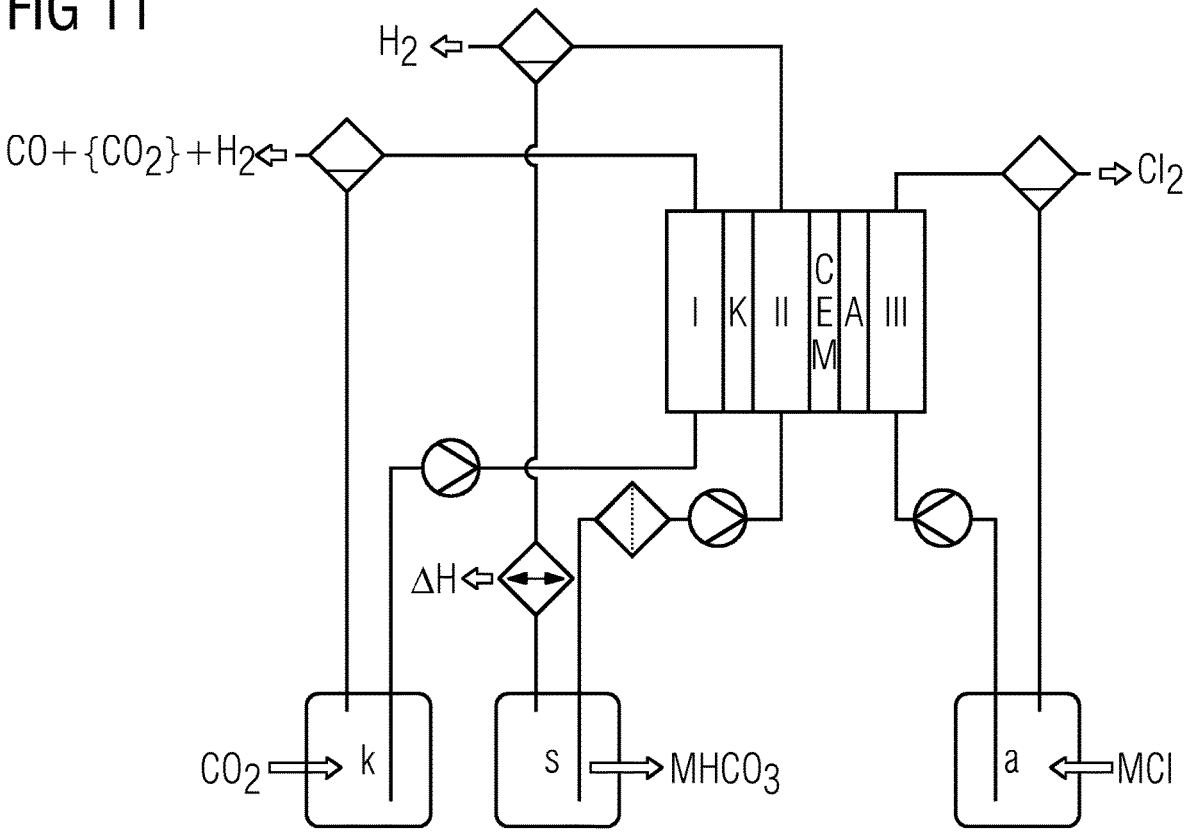

In FIGS. 3 and 11, the metal M is a monovalent metal which is not particularly restricted, for example an alkali metal such as Na and/or K.

The following reactions, for example, are possible:

1. Salt Formation (in the Case of a Basic Anode Reaction)

At the cathode, $HCO_3^-$ ions may be formed according to the following equation, by way of example for the conversion of $CO_2$ to CO.

$$3CO_2+H_2O+2e^-\rightarrow CO+2HCO_3^-$$

These may combine in the salt bridge with anodically generated cations (e.g. $K^+$) and form a salt. With advancing conversion, finally, the solubility of the salt in the salt bridge will be exceeded and it will precipitate out.

$$K^++HCO_3^-\rightarrow KHCO_3$$

The precipitation of the salt can be effected here in a controlled manner in particular embodiments, for example in a cooled crystallizer. In order to assure constancy in the system and a high purity of the salt crystallizing out—for example for commercial utilization—the composition of the salt bridge in particular embodiments may be chosen such that the hydrogencarbonate of the cation generated at the anode is the component having the lowest solubility. A corresponding method is described, for example, in WO 2017/005594.

In addition, some embodiments include using salts in the salt bridge that do not damage the electrodes in the event of trace diffusion through the membranes. In the case of K+, for example, it would be possible to use KF or even $KHCO_3$ itself close to the saturation concentration or mixing of the two salts as salt bridge.

2. Neutralization (in the Case of an Acidic Anode Reaction)

in the case of an acidic anode reaction, the cathodically generated $HCO_3^-$ ions may be neutralized by the anodically generated protons.

$$H^+ + HCO_3^- \rightarrow H_2O + CO_2$$

This results in release of gaseous $CO_2$ in the salt bridge. This is preferably removed effectively from the cell and may be further recycled into the catholyte k. Since this gas never comes into direct contact with the anolyte, no contamination by anode products that could damage the cathode (e.g. $Cl_2$ or $O_2$) is conceivable.

If the given reaction gives rise, for example, to anionic products such as formate or acetate, these are likewise transported away by the salt bridge and, in particular embodiments, can be removed by a suitable apparatus.

3. Neutralization (in the Case of Execution of the Second Ion Exchange Membrane as Bipolar Membrane)

In the case of the bipolar membrane too, neutralization of the cathodically generated hydrogencarbonate takes place in the salt bridge.

$$H^+ + HCO_3^- \rightarrow H_2O + CO_2$$

By contrast to the construction with CEM in conjunction with an acidic anode reaction, the protons here, however, come not from the anodic reaction but from the dissociation of water in the bipolar membrane. The exact nature of the anode reaction is thus unimportant here.

$$H_2O \rightarrow H^+ + OH^-$$

In particular embodiments, the method is a high-pressure electrolysis.

Advantages Associated with a High-Pressure Electrolysis:

At higher pressure, the $CO_2/HCO_3^-$ equilibrium goes in the $HCO_3^-$ direction, i.e. less gas is released. This can then be released at a later stage by partial expansion. By virtue of less gas forming in the salt bridge, the conductivity thereof is higher overall. Moreover, a higher $HCO_3^-$ concentration additionally increases conductivity.

There follows a comparison of the novel inventive construction of an electrolysis cell or of an electrolysis system in four standard electrolysis concepts, and some potential advantages are elucidated in detail.

Comparative Example I: Comparison with 2-Chamber Cell and AEM

Figure 9:
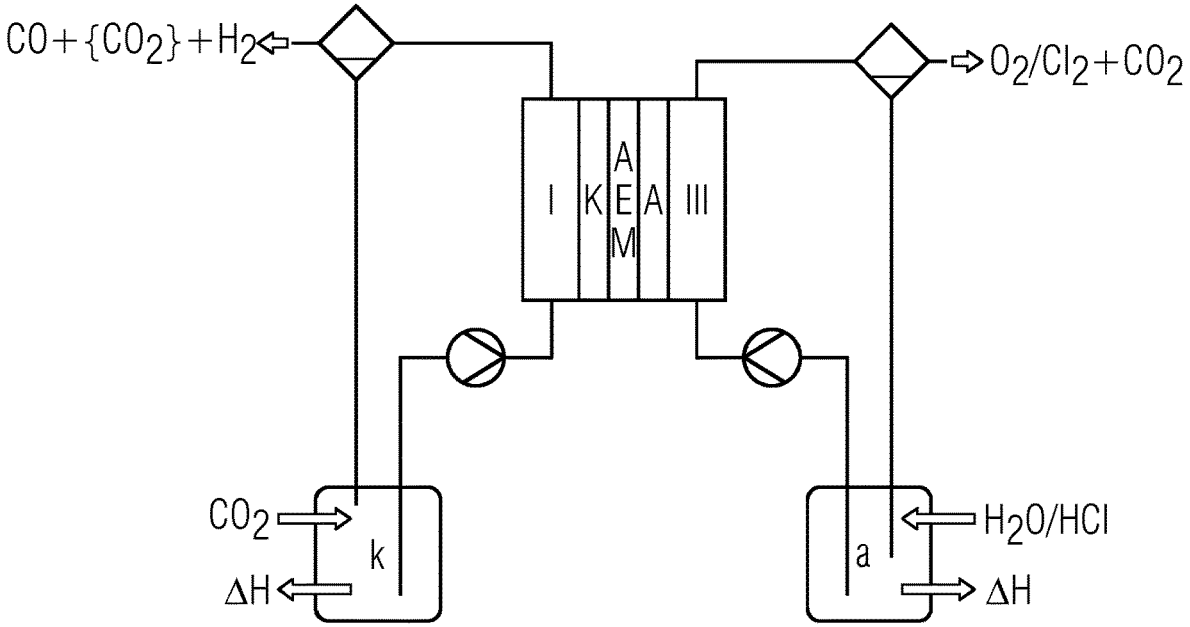
FIGS. 9 to 12 show, in schematic form, electrolysis systems of comparative examples incorporating teachings of the present disclosure.

FIG. 9 shows a two-chamber construction with an AEM as membrane, wherein the reference numerals correspond to those of FIGS. 1 to 4. At present, some developers (e.g. Dioxide Materials) are proposing a 2-chamber construction with AEM for $CO_2$ electrolysis. However, that construction is not advantageous compared to the one shown above. Firstly, cathodically generated $HCO_3^-$ ions can be guided through the AEM to the anode. In this case, $CO_2$ bound therein can be released again.

Example Equations:

$$4HCO_3^- O_2 + 2H_2O + 4e^- + 4CO_2$$

$$2HCO_3^- + 2HCl \rightarrow Cl_2 + 2H_2O + 2e^- + 2CO_2$$

This can result firstly in a massive loss of $CO_2$ (in the case of conversion to CO up to twice as much $CO_2$ can be lost as converted); secondly, the anode gas can be contaminated by $CO_2$, which is a major barrier to commercial utilization. In the case of some anode reactions (e.g. evolution of $Cl_2$), it is also possible for $Cl^-$ anions to migrate unhindered to the cathode and damage it. In the present 2-membrane construction, both of these can be prevented by the second membrane comprising a cation exchanger, for example a cation-selective membrane, on the anode side.

Comparative Example II: Comparison with 2-Chamber Cell and CEM

Figure 10:
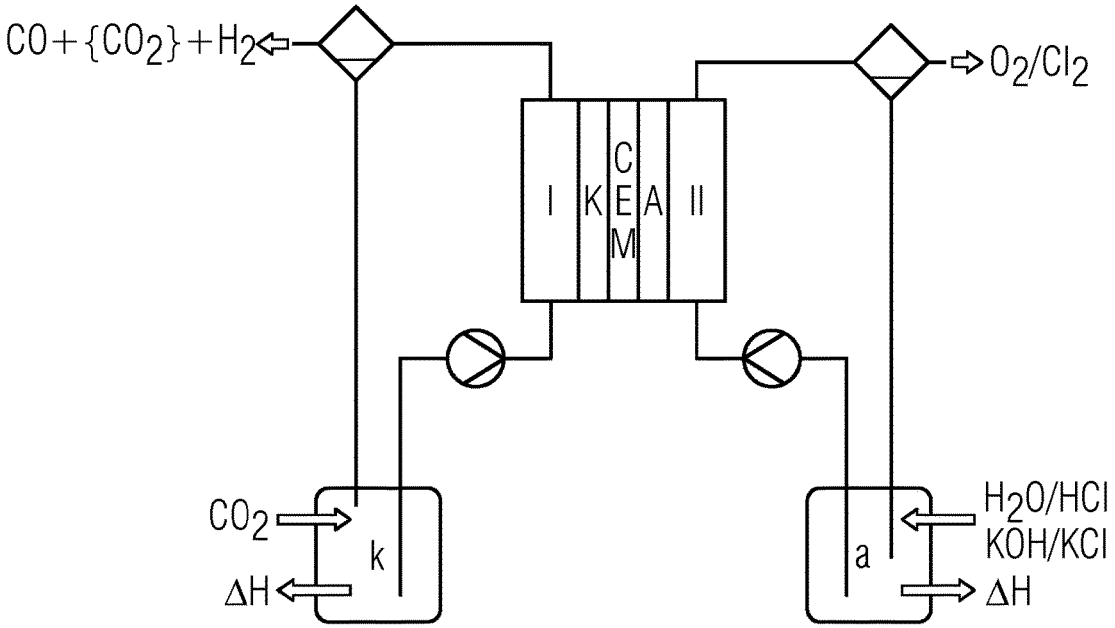

FIG. 10 shows a two-chamber construction with a CEM as membrane, wherein the reference numerals correspond to those of FIGS. 1 to 4. The construction shown is an adaptation of a PEM (proton exchange membrane) electrolyzer for hydrogen production. Since this contains a CEM, there is no loss of $CO_2$ via the anode gas, since the CEM can prevent the migration of $HCO_3^-$ ions into the anolyte.

However, the ionic connection of the cathode can be problematic. In the case of a basic anode reaction, a majority of the charge transport would be through cations such as K+, which cannot be converted in the cathode. This may result in an accumulation of hydrogencarbonates in the cathode, which can ultimately precipitate and block gas transport.

$$KOH + CO_2 \rightarrow KHCO_3$$

In the case of an acidic anode reaction, protons are transported to the cathode. Since CEMs are modified by highly acidic groups, the result is a very low pH at the cathode, which can be disadvantageous for the reduction of $CO_2$ by virtue of competing evolution of $H_2$.

Comparative Example III: Comparison with 3-Chamber Cell and CEM

FIG. 11 shows a three-chamber construction with a CEM as membrane, wherein the reference numerals correspond to those of FIGS. 1 to 4. The construction shown in FIG. 11 is utilized in chlor-alkali electrolysis for example. It differs from the present 2-membrane construction primarily by the lack of an AEM. An analog to FIG. 3 without an AEM is also possible.

In these constructions, electroosmosis in the case of conversion of $CO_2$ can become a problem. Since cations in particular have positive zeta potentials, they are pumped through the cathode into the catholyte space I in operation. They form $KHCO_3$ therein. The problem is known, for example, from ODC chlor-alkali electrolysis (with an oxygen-depolarized cathode; cathode substrate=$O_2$). A countermeasure typically used therein is enrichment of the $O_2$ with water vapor. As a result, a condensate film is deposited on the electrode, which washes the KOH formed away.

Since the solubility of $KHCO_3$ is many times lower than that of KOH, this countermeasure can fail in the case of highly concentrated and hence highly conductive salt bridges. This can then lead to a system failure. By introduction of an AEM, the charge transport of cations that "run into a cul-de-sac" is shifted toward $HCO_3^-$ ions that can be transported away by the salt bridge.

In the case of an acidic anode reaction, the electroosmotic removal of cations in the case shown in FIG. 11 can lead to a depletion of cations in the salt bridge, which can lead to reduced ion conductivity or undesirably low pH values. The advantage of the 2-membrane construction shown here thus lies in the suppression of the electroosmotic pumping of cations away into the catholyte, which promotes the use of highly concentrated electrolytes and high current densities. At the same time, it is possible to suppress contamination of the anode gas by $CO_2$.

Comparative Example IV: Comparison with 2-Chamber Cell and Bipolar Membrane

Figure 12:
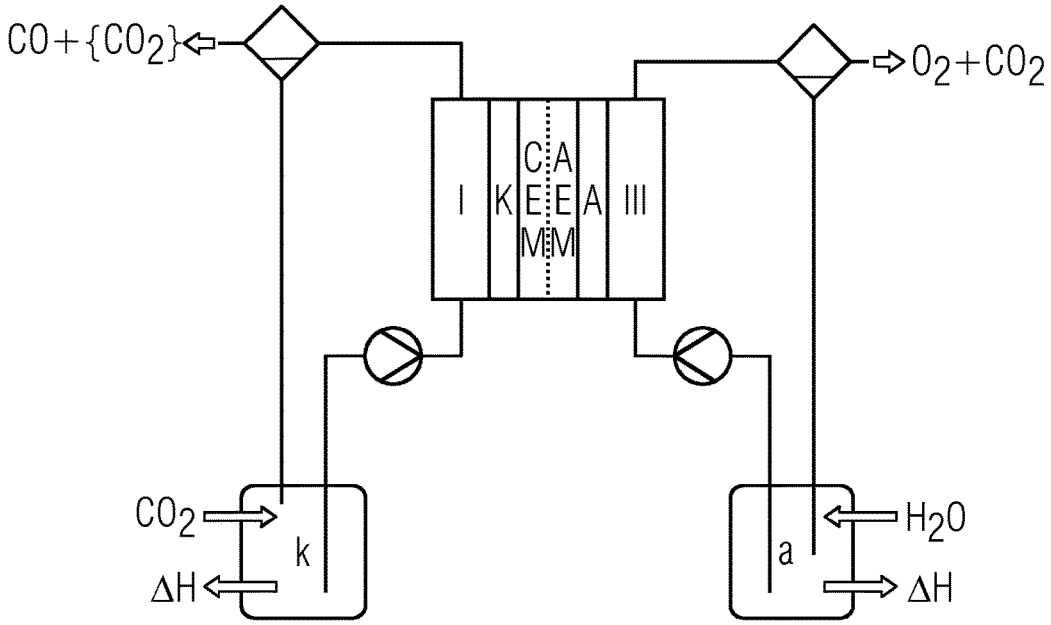

FIG. 12 shows a two-chamber construction with a bipolar membrane as membrane, wherein the reference numerals correspond to those of FIGS. 1 to 4.

For the electrolysis of $CO_2$, bipolar membranes are likewise under discussion. These are in principle a combination of a CEM and an AEM, as set out above. By contrast with the solution being discussed here, however, there is no salt bridge between the membranes, and the membrane constituents are inversely oriented: CEM to the cathode, AEM to the anode.

For the electrolysis of $CO_2$, pH values in the cathode region in the neutral to basic range may be advantageous. However, CEMs have typically been modified with sulfonic acid groups or other strongly acidic groups. A cathode catalyst connected to the membrane as in FIG. 12 is thus surrounded by strongly acidic medium, which strongly promotes the evolution of hydrogen over the reduction of $CO_2$. In order to obtain a neutral pH at the cathode catalyst, a buffered electrolyte must be introduced between the bipolar membrane and the cathode. In this case, however, the same cation pumping effect as in comparative example III would occur.

The above embodiments, configurations and developments can, if viable, be combined with one another as desired. Further possible configurations, developments and implementations of the teachings herein also include non-explicitly specified combinations of features of the invention that have been described above or are described hereinafter with regard to the working examples. More particularly, the person skilled in the art will also add individual aspects as improvements of or additions to the respective basic forms described herein.

EXAMPLES

Example 1

An electrolysis system was implemented on the laboratory scale in accordance with the diagram in FIG. 3. The ability of the cell to function was successfully demonstrated on the laboratory scale. The AEM and CEM used were A201-CE (Tokuyama) and Nafion N117 (DuPont). The salt bridge used was 2M $KHCO_3$. 2.5M aqueous KOH and water-saturated $CO_2$ served as anolyte and catholyte. The anode used was a mixed iridium oxide-coated titanium sheet. The anode in this case was not directly connected to the CEM. The chamber III was thus between the anode and CEM, as shown. The cathode used was a commercial carbon gas diffusion layer (Freudenberg H2315 C2) coated with a copper-based catalyst and the anion-conductive ionomer AS-4 (Tokuyama). It lay directly atop the AEM.

At a current density of 100 $mA/cm^{-2}$, it was possible to simultaneously achieve 30% current yield for ethene and 26% current yield for CO. It was likewise possible to operate the cell, albeit at slightly lower selectivities, at up to 200 $mAcm^{-2}$. In spite of the anode not being positioned directly atop the CEM and non-optimized mechanical support structures in the electrolyte chamber, the terminal voltage at 100 $mAcm^{-2}$ was 4.7 V.

No gas bubbles were observed in the salt bridge. Even at 200 $mAcm^{-2}$, there was no observation of any distinct "back-bleeding" (liquid transport caused by electroosmosis through the GDE from the salt bridge into the catholyte) or of any deposition of salts on the reverse side of the GDE.

Example 2 (Comparative Example) and Example 3

A further construction was compared to the construction from example 1, in which there was no cathode-AEM composite. The further construction corresponded to that of example 1, with use of a silver cathode as cathode (example 2). The inventive example used was an experimental setup according to example 1, except that the cathode used was a silver cathode (example 3).

Figure 13:
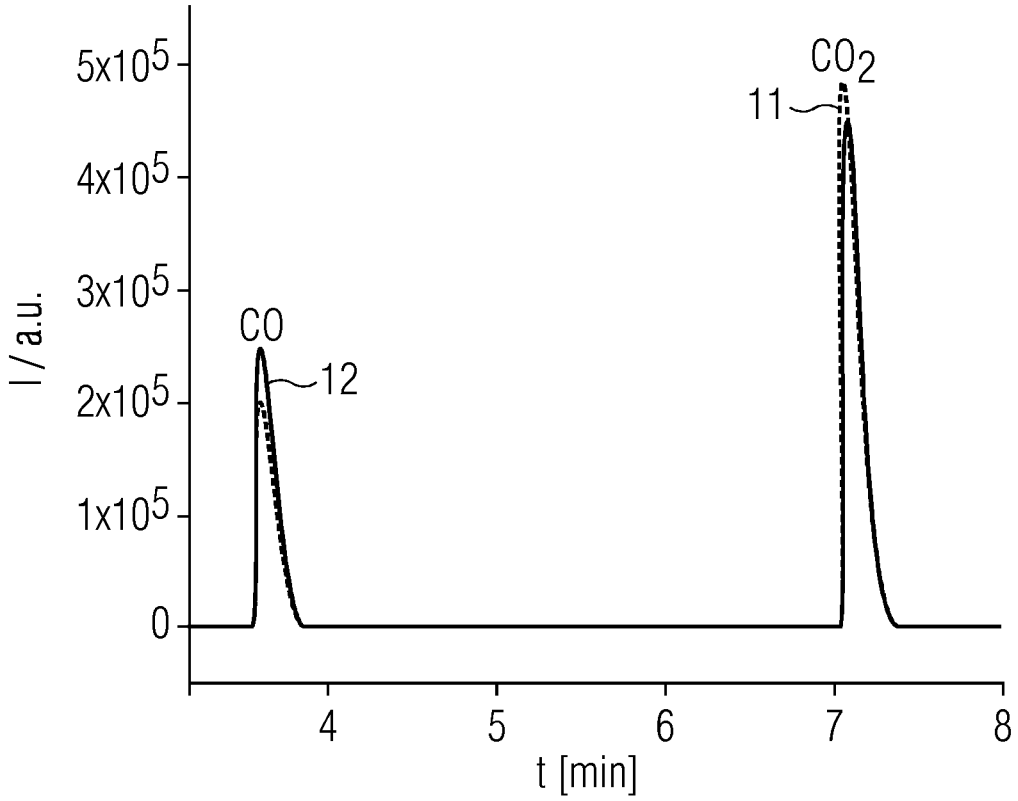
FIG. 13 shows data for results that have been obtained in example 2.

FIG. 13 shows the comparison of two chromatograms from example 3 and example 2. These were recorded under identical conditions: equal current density, silver cathode, virtually equal Faraday efficiency (~95% for CO) and equal $CO_2$ excess.

In the first experiment (example 2; 11 in FIG. 13), no cathode-AEM composite was used and the gas streams from the salt bridge and the catholyte were necessarily combined.

In the second experiment, a cathode-AEM composite was utilized and the gas in the salt bridge was measured separately (analogously to example 1; 12 in FIG. 13).

As apparent from FIG. 13, the CO content is significantly higher in the product gas in the latter experiment, corresponding to example 3. It is 25% in the first case, 34% in the second.

A gas in the salt bridge that was observed in example 3 was almost pure $CO_2$>99%, which can thus be fed directly back to the cathode feed. The cathodic products passed through the AEM only in traces (~6‰ $H_2$/~2‰ CO).

This shows the suitability of double membrane cells for the enrichment of the product gas with $CO_2$ without losing it.

What is claimed is:

1. An electrolysis system comprising:

an electrolysis cell comprising:

a cathode space housing a cathode;

a first ion exchange membrane including an anion exchanger and adjoining the cathode space;

an anode space housing an anode;

a second ion exchange membrane comprising a bipolar membrane including a cation exchanger and an anion exchanger, the second ion exchange membrane adjoining the anode space;

a salt bridge space disposed between the first ion exchange membrane and the second ion exchange membrane; and an electrolyte fed into the salt bridge space, the electrolyte comprising an aqueous solution of conductive salts;

wherein the cathode comprises a porous conductive support impregnated with a catalyst comprising an ionomer at least partially penetrating the porous conductive support and acting as a fixed electrolyte; and a recycling unit connected to an outlet from the salt bridge and an inlet into the cathode space.

2. The electrolysis system as claimed in claim 1, wherein the recycling unit conducts a reactant from the cathode reaction formed in the salt bridge space back into the cathode space.

3. The electrolysis cell as claimed in claim 1, wherein the cathode is in contact with the first ion exchange membrane.

4. The electrolysis cell as claimed in claim 1, wherein the anode is in contact with the second ion exchange membrane.

5. The electrolysis cell as claimed in claim 1, wherein the second ion exchange membrane comprises a bipolar membrane.

6. The electrolysis cell as claimed in claim 1, wherein at least one of the first ion exchange membrane and the second ion exchange membrane is hydrophilic.

7. The electrolysis cell as claimed in claim 1, wherein at least one of the anode and the cathode is in contact with a conductive structure on a side remote from the salt bridge space.

* * * * *